US006718870B1

(12) United States Patent
Frenken

(10) Patent No.: US 6,718,870 B1
(45) Date of Patent: Apr. 13, 2004

(54) HAND-HELD HYDRAULIC PRESSING APPARATUS

(75) Inventor: Egbert Frenken, Wermelskirchen (DE)

(73) Assignee: Gustav Klauke GmbH (DE)

( * ) Notice: Subject to any disclaimer, the term of this patent is extended or adjusted under 35 U.S.C. 154(b) by 0 days.

(21) Appl. No.: 09/528,731

(22) Filed: Mar. 20, 2000

(30) Foreign Application Priority Data

Sep. 15, 1999 (DE) ..... 199 44 229

(51) Int. Cl.[7] ..... B30B 1/00

(52) U.S. Cl. ..... 100/266; 100/102; 100/103; 100/231; 100/269.01; 100/269.15; 173/170

(58) Field of Search ..... 100/102, 103, 100/231, 269.01, 269.15, 266; 81/301; 29/252, 275, 276; 173/13, 17, 216, 170, 128, 217; 30/92, 363, 122

(56) References Cited

U.S. PATENT DOCUMENTS 2,239,090 A * 4/1941 Everett ..... 173/128
3,390,446 A * 7/1968 Ettorre ..... 29/252
4,151,720 A * 5/1979 Vanderstappen ..... 81/301
4,206,603 A * 6/1980 Mekler ..... 60/477
4,512,222 A * 4/1985 Christophersen ..... 29/276
4,823,588 A * 4/1989 Bussereau et al. ..... 60/477
4,974,685 A * 12/1990 Coffenberry ..... 173/128
5,033,552 A * 7/1991 Hu ..... 173/170
5,251,367 A * 10/1993 Ward et al. ..... 173/168
5,533,579 A * 7/1996 Chu ..... 173/17
6,000,680 A * 12/1999 Kimura et al. ..... 30/228
6,003,416 A * 12/1999 Ando et al. ..... 82/160
6,170,579 B1 * 1/2001 Wadge ..... 173/170

* cited by examiner

*Primary Examiner*—John Sipos
*Assistant Examiner*—Louis Huynh
(74) *Attorney, Agent, or Firm*—Trexler, Bushnell, Giangiorgi, Blackston & Marr, Ltd.

(57) ABSTRACT

The invention is concerned with a hand held hydraulic pressing apparatus (1) with a hydraulic cylinder (8), in which a hydraulically actuated piston can be displaced to carry out a pressing or cutting operation. The apparatus has a piston head (5) and a piston shank (16), the piston shank (16) being connected to a tool carrier (10). The tool carrier (10) is part of an inter-changeable apparatus head (9). In order to simplify to change the apparatus head, the invention proposes, that an interchangeable apparatus head (9) has in each case a piston shank (16) with a return spring (22).

16 Claims, 7 Drawing Sheets

HAND-HELD HYDRAULIC PRESSING APPARATUS

BACKGROUND

The invention relates first of all to a hand-held hydraulic pressing apparatus with a hydraulic cylinder in which a hydraulically actuated piston can be displaced to carry out a pressing or cutting operation, with a piston head and a piston shank, the piston shank being connected to a tool carrier, and the tool carrier being part of an interchangeable apparatus head.

A hand-held pressing apparatus of this kind is known, for example, from DE-A1 197 16 804. This shows a hand-held pressing apparatus with a piston shank that can be screwed to the tool carrier of an interchangeable apparatus head and is formed in one piece with the hydraulically actuatable piston head.

With regard to the prior art described above, a technical problem for the invention is seen in further developing a hand-held hydraulic pressing apparatus of the type under discussion in an advantageous manner, particularly as regards making it simpler to change the apparatus head.

SUMMARY

This problem is solved first and foremost by the subject-matter of claim 1, it being proposed that an interchangeable apparatus head should in each case have a piston shank with a return spring. In contrast to the known prior art, the piston shank in the configuration according to the invention is associated with the apparatus head. When the apparatus head is removed from the hand-held pressing apparatus, the tool carrier arranged displaceably in the apparatus head is always held in an initial position, i.e. in an open position, by the return spring which is also provided, this open position of the tool carrier corresponding, in the position in which the apparatus head is associated with the hand-held pressing apparatus, to the initial position, i.e. the returned position of the hydraulically actuatable piston or piston head. By virtue of this configuration, various interchangeable apparatus heads can be available in a stand-by position, i.e. in an open position, for fitting with pressing or cutting tools for example. It also proves advantageous here that once an interchangeable apparatus head formed in this way has been mounted on the hand-held pressing apparatus, the hydraulically actuatable piston or piston head is in its returned position, which can be defined as the initial position. By virtue of the configuration according to the invention, the apparatus head can be interchanged in an extremely simple manner. The cup- or disc-shaped piston head, which is provided with a hydraulic seal, for example in the form of an O-ring seal with a back-up ring, remains in the hydraulic cylinder on the apparatus. The piston shank, in contrast, is a separate component and, together with the return spring, is associated with the apparatus head. This advantageously allows the basic hand-held pressing apparatus to be preassembled, filled with oil and checked after repair work, for example. If required, a mating apparatus head is fitted. In the case of a repair, it is furthermore possible to exchange the apparatus head or basic apparatuses in a simple modular manner. Moreover, it is possible to change between pressing and cutting apparatus heads, for example, depending on the application, and, by virtue of the two-part nature of the piston, the exchange takes place on the dry side of the apparatus. The hydraulic side remains reliably closed by the piston head, which remains in the apparatus, thus eliminating the involved process of bleeding the system.

The invention furthermore relates to a hand-held pressing apparatus in accordance with the features of the precharacterizing clause of claim 1, where, as an advantageous refinement, the piston shank merely subjects the piston head to pressure without being connected to it. According to the invention, a two-part piston is provided here, having a piston head associated with the hand-held pressing apparatus and a piston shank associated with the apparatus head. The piston head, which is hydraulically pressurized when the apparatus is actuated, pushes the tool carrier via the piston shank, which is connected to the tool carrier, into the working position to press or cut objects. Upon manual actuation or automatic triggering when a predetermined pressure is exceeded, the piston shank together with the tool carrier moves back into the initial position, subjecting the piston head to pressure as it does so. This return movement is preferably brought about by a return spring acting on the piston shank. According to the invention, the piston shank and the piston head are not connected to one another, so that removing the apparatus head provided with the piston shank has no effect on the piston head. The latter always remains in its position, preferably in the returned position, to seal off the oil in contact with its rear side.

The invention also relates to a hand-held pressing apparatus in accordance with the features of the precharacterizing clause of claim 1, the proposal being made here, with a view to an advantageous further development, that the piston shank be connected to the piston head in a manner which allows it to be released in operation. In accordance with the previous embodiments, the piston is of two-part form in the case of this solution also, with a piston head associated with the basic hand-held pressing apparatus and a piston shank associated with the apparatus head. It is, for example, possible to provide here a releasable connection between piston shank and piston head which is accessible from the outside for removal of the apparatus head from the hand-held pressing apparatus. Possibilities that may be considered here are an axial screw connection or a bayonet connection between piston shank and piston head. This connection can be released to remove the apparatus head, after which the apparatus head can be removed in an extremely simple manner from the hand-held pressing apparatus. Here too, the sealing piston head remains in the basic apparatus.

The solutions described above can be used both separately and in combination.

Irrespective of the possible solutions described above, a further proposal is that a compression spring for returning the piston should be held captive on the piston shank. Even when the apparatus head has been removed from the apparatus, the piston shank is accordingly always loaded into an initial position-preferably an open position of the tools. Another provision is that the piston head has a centering recess or a centering projection on the piston-shank side and that the piston shank has a centering projection or a centering recess on the piston-head side. According to this configuration, the two parts of the two-part piston transmit only compressive and side forces to one another. The configuration according to the invention furthermore provides centering properties for the precise axial alignment of the piston shank. As an alternative to or in combination with this, provision can be made for a cylindrically-headed screw with a projecting cylindrical head to be mounted centrally in the piston shank on the piston-head side to ensure centering on the piston head, the cylindrical head being received in a corresponding recess in the piston head. As a further refinement of the subject-matter of the invention, provision is made for the return spring on the apparatus-head side to surround the piston shank and to be supported, at one end, on the apparatus head and, at the other end, on the piston shank in the region of the free end of the shank, which is associated with the piston head. For this purpose, a radial extension can be provided on the piston shank, which simultancously forms a centering projection. In a preferred configuration, the piston head on the apparatus is or disc-shaped form and has a radial scal. As an alternative, provision can also be made for the piston head to have a cup wall on the piston-shank side, the outside diameter of this cup wall being matched approximately to the inside diameter of the hydraulic cylinder. When the apparatus head and the hand-held pressing apparatus are coupled together, the cup wall accommodates the piston shank, if appropriate together with the return spring surrounding the shank. It has proven advantageous, particularly as regards the guiding properties of the piston head, for the height of the cup wall in the axial direction to correspond to more than a quarter of the length of the shank. The cup wall can furthermore also serve as an end stop in the course of the pressing operation, the annular end face of the cup wall engaging against a collar on the apparatus head, this collar projecting radially inwards into the path of motion As regards the fixing of the apparatus head on the basic apparatus, it is proposed that the hydraulic cylinder have an external thread on its end facing the apparatus head and that the apparatus head be connected to the hydraulic cylinder by means of this thread. As a result, the apparatus head can be unscrewed form the hand-held apparatus in an extremely simple manner while simultaneously pulling the piston shank out of the hydraulic cylinder together with the return spring, the piston head remaining in the basic apparatus maintaining its position. It has proven particularly advantageous here if the location of the connection between the apparatus head and the hydraulic cylinder is defined by an index pin. As a result of this, a defined connecting position is provided. When the predefined connecting position is reached, the index pin enters a recess in the hydraulic cylinder in a spring-assisted manner. According to a further proposal, the piston shank is of stepped form and is connected to the apparatus head by means of a counterholder component which is supported on the apparatus head and engages against the step face. This counterholder component on the one hand forms a stop face for the tool carrier. The return spring acting on the piston shank is preferably supported on the side opposite this stop face. This counterholder component is advantageously supported against a step on the apparatus-head side and can be inserted in an extremely simple manner. As an alternative, however, provision can also be made for the counterholder component to be screwed into the bore in the apparatus head which accommodates the hydraulic cylinder using the same thread for connecting the apparatus head to the hydraulic cylinder. A construction in which the apparatus head has a handle has proven particularly advantageous in terms of handling. This is furthermore preferably formed in such a way that the handle extends in the direction of motion of the piston or hydraulic cylinder. Finally, provision is made for the handle to be formed by an arc-shaped component which merges into the apparatus head at both ends.

BRIEF DESCRIPTION OF THE DRAWING

The invention is explained below in greater detail with reference to the attached drawing, which shows only a number of illustrative embodiments and in which:

FIG. 7 shows a partially sectioned side view related to FIG. 6;

DESCRIPTION

Figure 1:
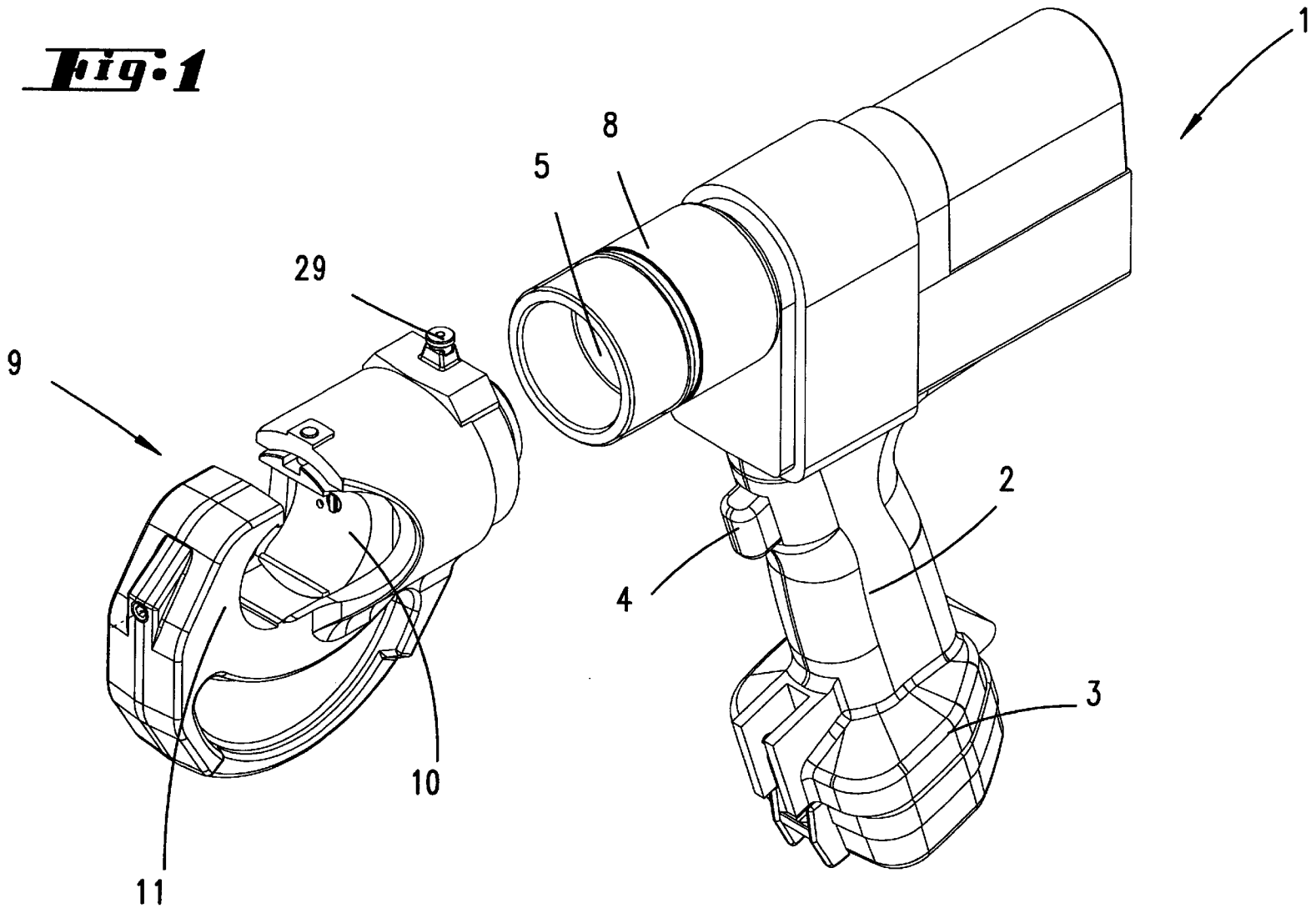
FIG. 1 shows a hand-held hydraulic pressing apparatus according to the invention with an interchangeable apparatus head that can be associated with it, in perspective representation.

The first item illustrated and described, with reference to FIG. 1, is a hand-held hydraulic pressing apparatus 1 operated by electric motor. A pressing apparatus of this kind is known from DE-A1 197 16 804 mentioned at the outset. The content of this patent application is hereby incorporated fully into the disclosure of the present invention, also for the purpose of incorporating features of this patent application into claims of the present invention.

An electric motor is disposed in the hand-held pressing apparatus 1. Drive of this electric motor is effected by means of a battery 3 integrated into a handle 2. When a finger-operated switch 4 is actuated, oil is pumped out of a reservoir into a pressure space, thereby moving a piston, according to the invention a piston head 5, in the direction of its working end position.

Figure 6:
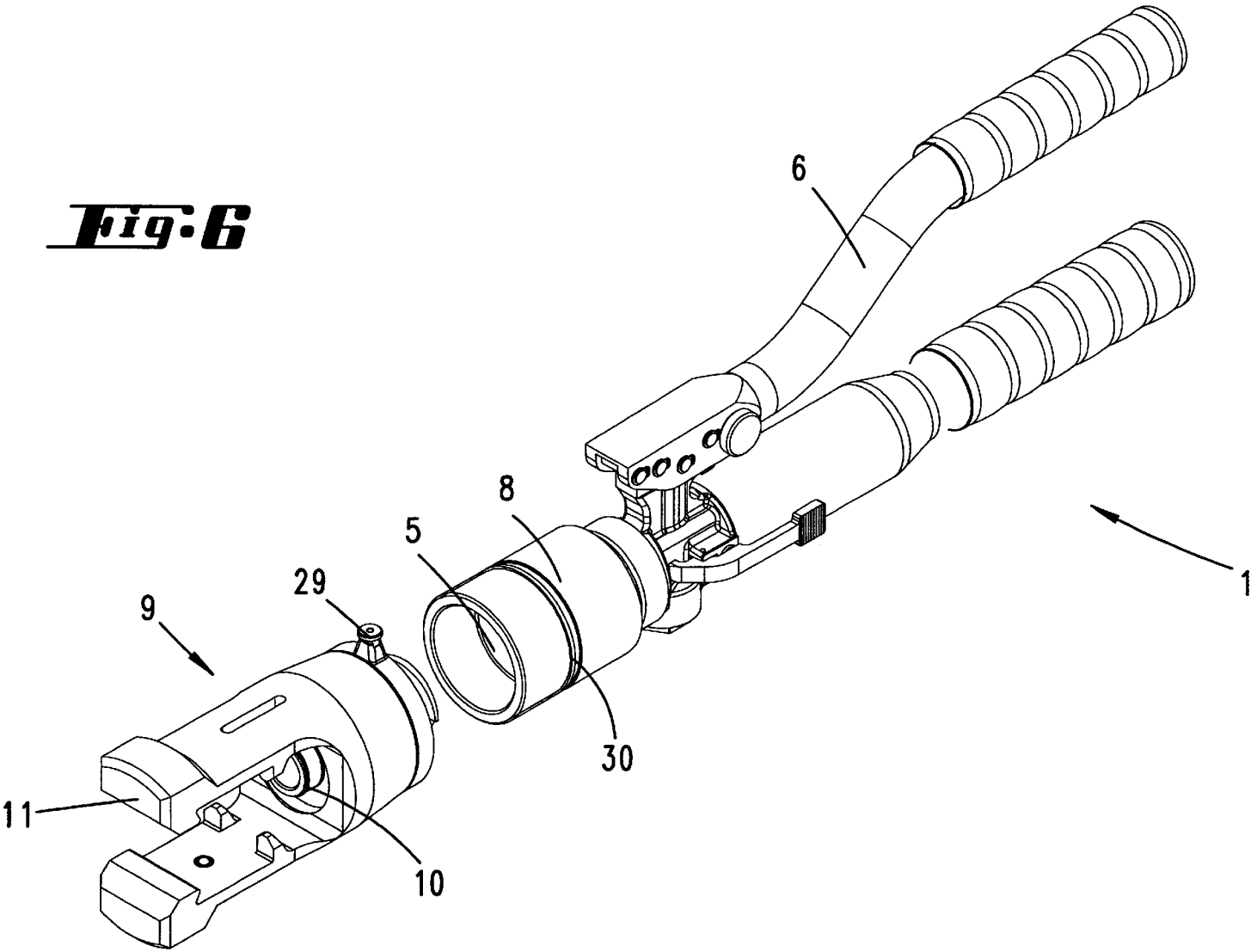
FIG. 6 shows in perspective view another combination of a manually actuatable pressing apparatus with another interchangeable apparatus head.
Figure 1:
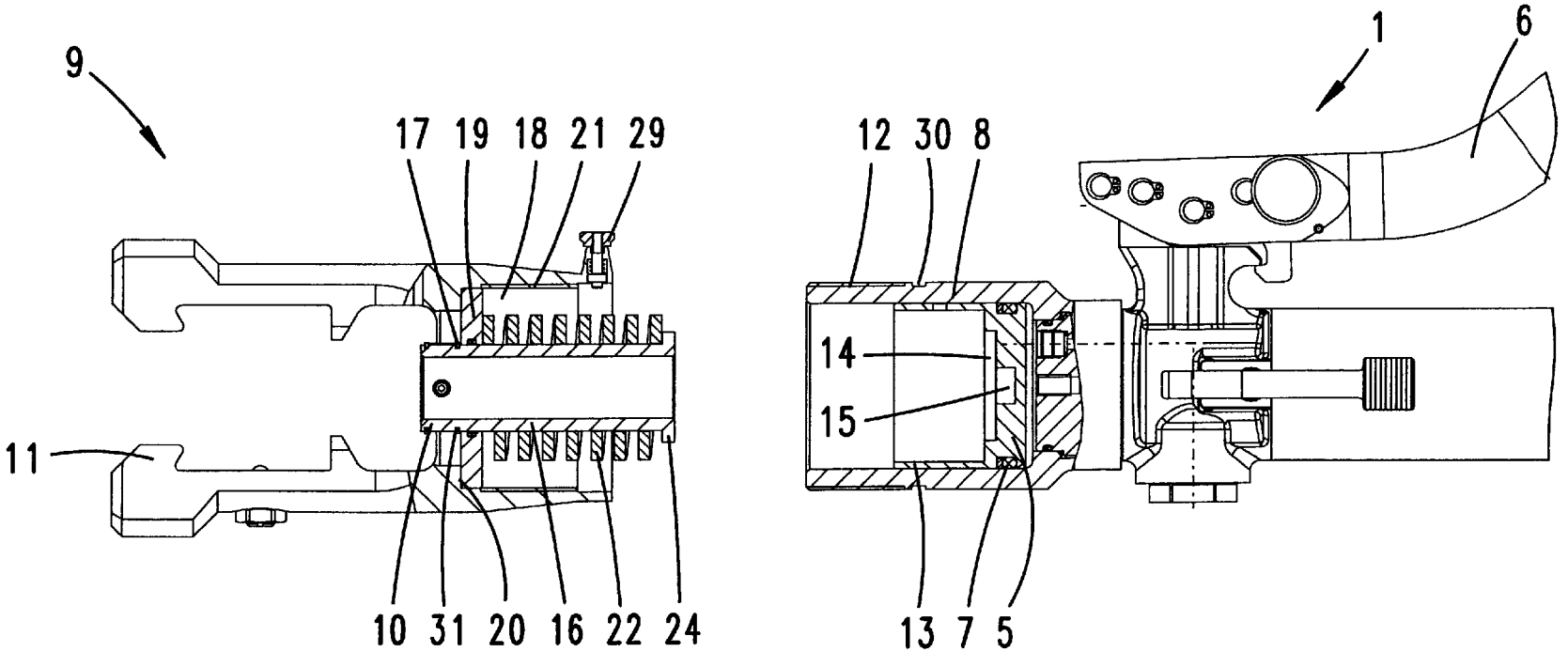

The hand-held pressing apparatus 1 illustrated in FIG. 6 is designed as a lever-actuated apparatus. The pressure required to displace the piston head 5 is accordingly not built up by electric motor but by manual actuation using a pumping lever 6.

Irrespective of the design of the hand-held pressing apparatus 1, it has a hydraulic cylinder 8 which surrounds the dish-like piston head 5, which has a radial seal 7, and on which cylinder an interchangeable apparatus head 9 can be disposed. In FIGS. 1 to 4, there is shown a first apparatus head 9, the tool carriers 10, 11 of which can be fitted with pressing tools (not shown).

Figure 8:
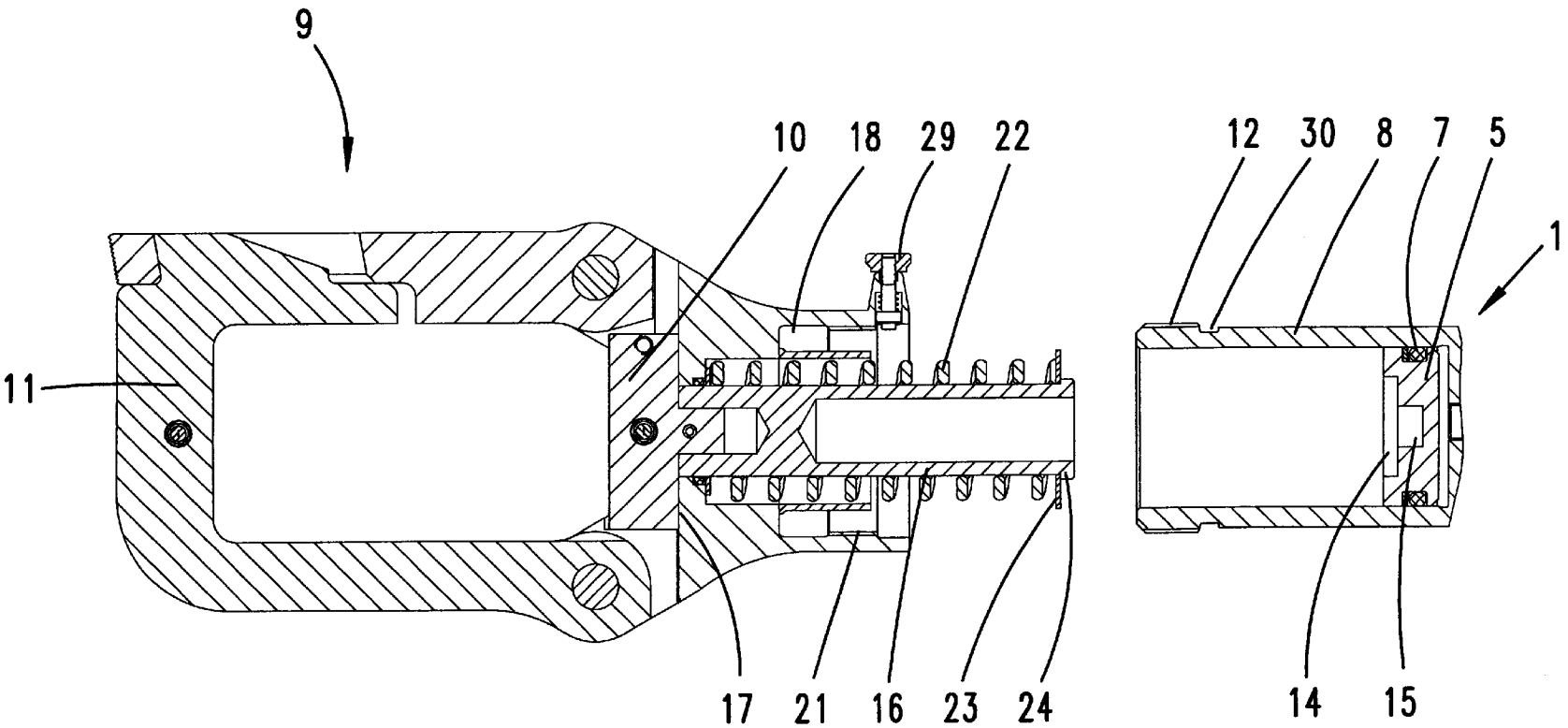
FIG. 8 shows a sectional representation of another interchangeable apparatus head which can be associated with a hydraulic cylinder with a piston head, in a second embodiment.

In FIGS. 6 and 7, there is shown another interchangeable apparatus head 9. FIG. 8 shows another interchangeable apparatus head 9. This is designed as a universal apparatus head for holding different tools. As regards the design of this apparatus head 9 in FIG. 8, attention is drawn to German Patent Application 199 26 481, which is not a prior publication. The content of this patent application is also hereby incorporated fully into the disclosure of the present invention, also for the purpose of incorporating features of this patent application into claims of the present invention.

The design of the tool-carrier holder on the apparatus, formed by hydraulic cylinder 8 and piston head 5, is substantially identical, irrespective of the configuration of the hand-held pressing apparatus 1. This applies also to the connecting region of the various interchangeable apparatus heads 9. As a result, each interchangeable apparatus head 9 can be associated both with the hand-held pressing apparatus 1 according to FIG. 1 and with the hand-held pressing apparatus 1 of the pumping-lever type according to FIG. 6.

The hydraulic cylinder 8, which is of substantially cup-shaped form, is open in the direction of the apparatus head 9 and, on the one hand, its inner wall serves to guide the piston head 5, while on the other hand, the outside is used for connecting the hand-held pressing apparatus 1 to the apparatus head 9, for which purpose the hydraulic cylinder 8 has an external thread 12 on its outer wall.

As mentioned, the initially disc-shaped piston head 5 is provided with a hydraulic seal 7, for example, in the form of an O-ring seal with a back-up ring, to provide a seal relative to the inner wall of the hydraulic cylinder.

Figure 2:
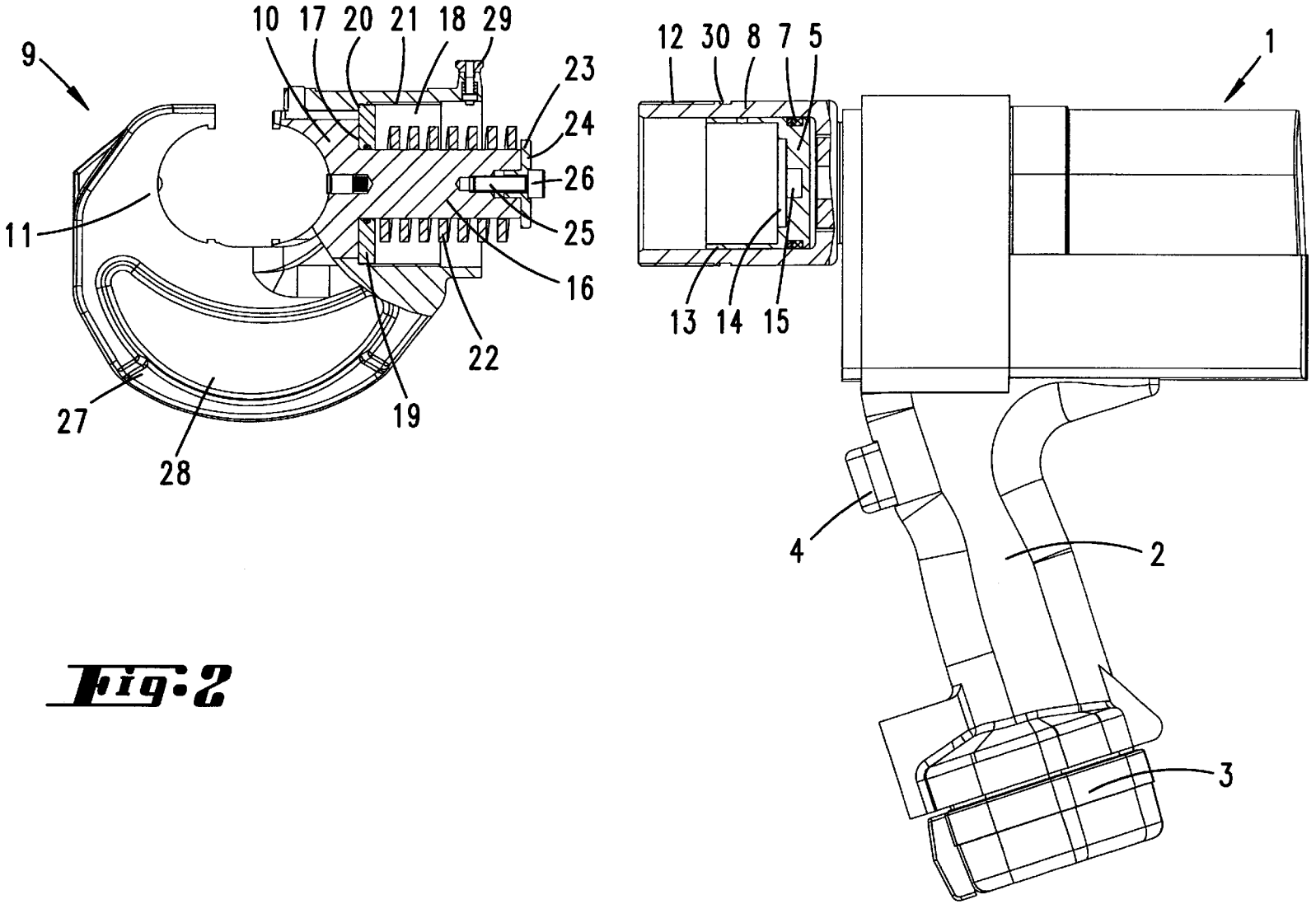
FIG. 2 shows a related, partially sectioned side view.

In the case of a cup-like configuration of the piston head 5 in accordance with the embodiment in FIG. 2, the piston head 5 is provided with a coaxially aligned cup wall 13 which is supported on the outside on the inner wall of the hydraulic cylinder 8.

Measured in the direction of displacement of the piston head 5, the height of the cup wall 13 corresponds approximately to half the socket depth of the hydraulic cylinder 8, measured in the same direction.

On the side associated with the apparatus head 9, the piston head 5 mounted on the apparatus has a central, circular, stepped recess, a first centering 14 of larger diameter and a second, subsequent recess 15 of reduced diameter.

The apparatus head 9 shown in FIGS. 1 to 5 has a tool carrier 10, which can be displaced by means of the hand-held pressing apparatus 1, and a fixed tool carrier 11 lying opposite the first tool carrier.

At the rear, the displaceable tool carrier 10 is provided with a piston shank 16 which, in the illustrative embodiment shown, is formed as one piece with the tool carrier 10. As an alternative, it is also possible for the piston shank 16 to be for example screw connected to the tool carrier 10.

According to this configuration, the piston acting on the tool carrier 10 is provided divided into two parts, one part—the piston head 5—being located on the apparatus and the second part—the piston shank 16—being located on the apparatus head.

In the region of the transition to tool carrier 10, the piston shank 16 is of stepped configuration, such that, in this region, a stop face 17 acting in the direction of opening of the apparatus head 9 and having a larger diameter than the piston shank is formed.

In the open position according to FIG. 2, this stop face 17 engages against a counterholder 19 inserted into a bore 18 through which the piston shank 16 passes. The said counterholder is of annular configuration and is pushed in against a step 20 of the bore 18 in a stop—limited manner. The piston shank 16 passes centrally through the counterholder 19, which centres it.

The diameter of the bore 18 is matched to the outside diameter of the hydraulic cylinder 8 and the bore 18 has an internal thread 21 that can be associated with the external thread 12.

The diameter of the piston shank corresponds approximately to half the diameter of the bore 18.

The piston shank 16 which is surrounded by a compression spring 22, passes centrally through the bore 18, its free end projecting over about a quarter of its total length from the bore 18. This free end of the piston shank 16 is provided with a supporting washer 23 which is located at the end and is of larger diameter than the piston shank, this washer being used, on the one hand, to support the compression spring 22 and, on the other hand, as a centering projection 24 for location in the centering recess 14 of the piston head 5. The diameter of the centering projection is accordingly matched to the diameter of the centering recess in the piston head 5. The thickness of the centering projection 24 or supporting washer 23, measured in the axial direction, furthermore corresponds to the correspondingly measured depth of the centering recess 14.

The supporting washer 23 is fixed on the piston shank 16 by means of an axially arranged screw 25 having a cylindrical head, the cylindrical head 26 protruding above the supporting washer 23. The second recess 15 provided in the piston head 5 is matched to the diameter and the height, measured in the axial direction, of the cylindrical head 26.

As described, one end of the compression spring 22 mentioned is supported on the supporting washer 23 on the piston shank, more specifically on the centering projection 24 formed by the said supporting washer, and its other end is supported on the counterholder 19, which simultaneously forms the stop for the piston shank 16 and the displaceable tool carrier 10. As a result, the piston shank 16 and the tool carrier 10 are always spring-loaded into an open position according to FIG. 2.

The apparatus head 9 according to the representations in FIGS. 1 to 5 is furthermore provided with a handle 27, which extends in the direction of motion of the piston shank 16 and the displaceable tool carrier 10. In this specific case, the handle 27 is located on the underside of the apparatus head 9, the handle 27 being formed by an arc-shaped component 28 which merges at both ends into the apparatus head 9.

The apparatus head 9 can be associated with the hand-held pressing apparatus 1 in an extremely simple manner. The apparatus head 9 is, for instance, pushed over the hydraulic cylinder 8 and screw-connected to it by means of the external thread 12 on the apparatus and the mating internal thread 21 on the apparatus head. The predetermined connecting position according to FIG. 3 of the apparatus head 9 and the hydraulic cylinder 8 is defined by an index pin 29. The latter is located on the apparatus head 9 and, in the predefined connecting position, enters with spring assistance into a radial groove 30 formed on the outside of the hydraulic cylinder 8.

Figure 3:
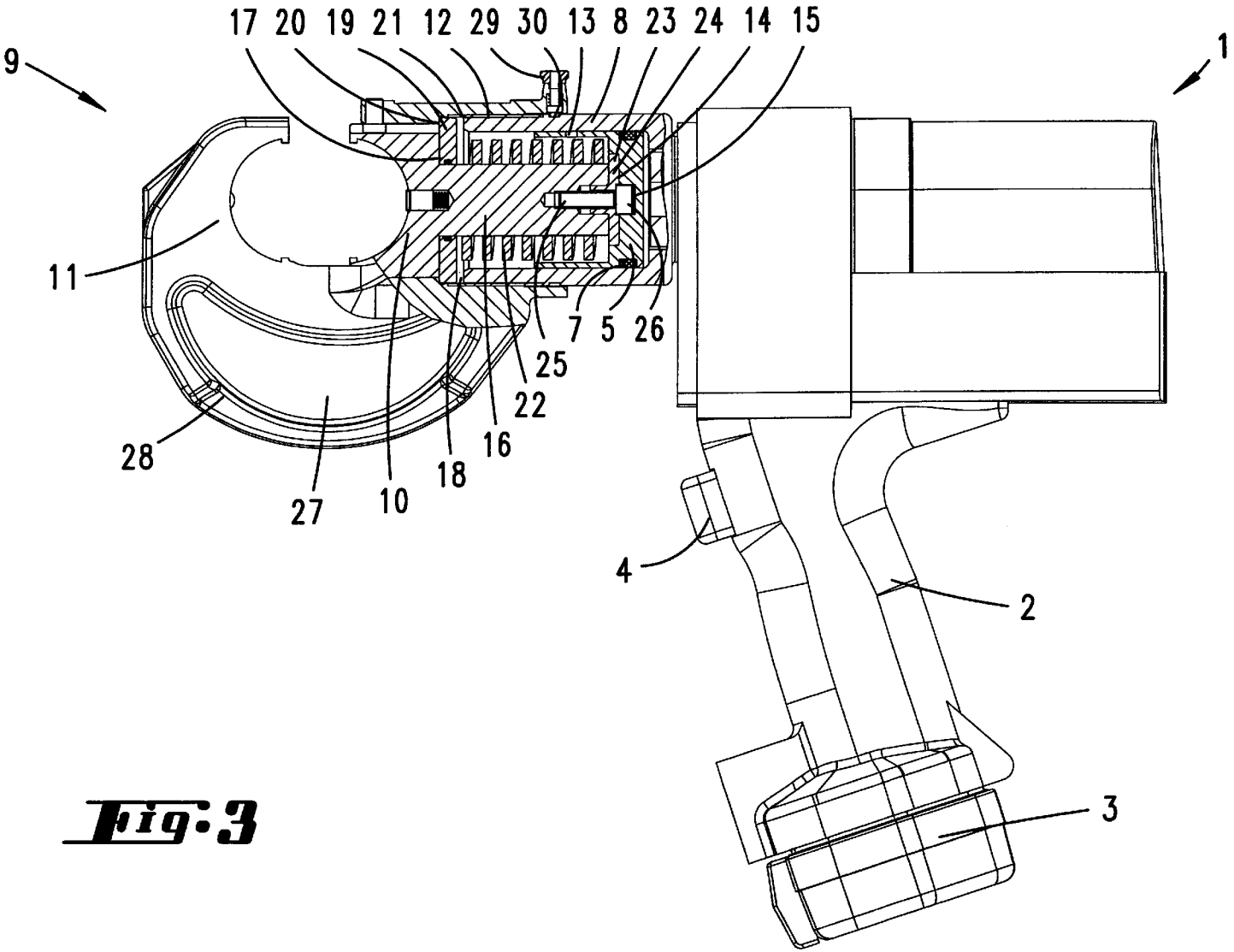
FIG. 3 shows a side view corresponding to that in FIG. 2 after the inter-changeable apparatus head has been connected to the hand-held pressing apparatus, this figure relating to the unpressurized initial position.
Figures 4, 5:
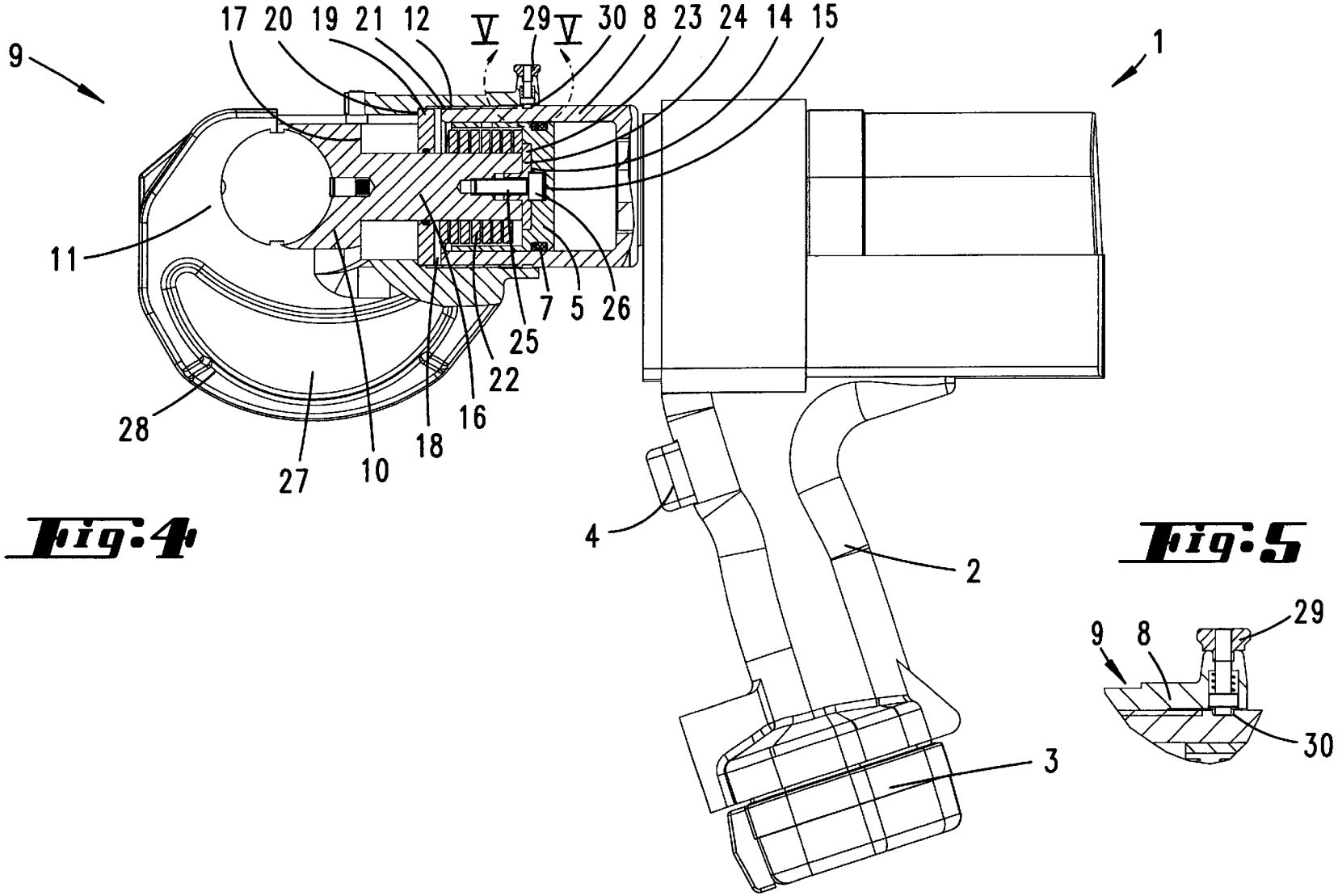
FIG. 4 shows an illustration corresponding to that in FIG. 3, relating to a pressurized working position.
FIG. 5 shows an enlarged detail of the area V—V in FIG. 4.

In the stand-by position according to FIG. 3, the centering projection 24 of the piston shank 16 is in the associated centering recess 14 of the piston head 5 and the cylindrical head 26 of the cylindrically—headed screw 25, which furthermore also has centering properties, is additionally accommodated in the second recess 15.

The cup wall 13 of the piston head 5 surrounds part of the length of the compression spring 22.

As a result of the two-part configuration of the piston, the piston head 5 and the piston shank 16 transmit only compressive forces form one to the other and, in addition, by virtue of the positive fit of the centering projection 24 in the centering recess 14, also side forces from one to the other. Tensile forces are not transmitted because of the lack of a connection.

When the hand-held pressing apparatus 1 is actuated, oil is pumped into a pressure space, the piston head 5 thereby being moved in the direction of its working end position counter to the action of the compression return spring 22.

The return motion of the piston head 5 is accomplished by means of the compression return spring 22, which acts on the piston head 5 via the centering projection 24 as soon as a nonreturn valve opens when a predetermined maximum pressure is exceeded The hydraulic cylinder 8 or the holder thereby formed for an interchangeable apparatus head 9 according to the representations in FIGS. 6 and 7 is of identical design to the cylinder associated with the hand-held pressing apparatus described above.

On the other hand, there are differences in the design of the piston shank 16 in the apparatus head 9 in FIGS. 6 and 7, although compatibility with the apparatus head 9 described above is maintained.

Here, the piston shank 16 is formed as a component in the form of a hollow cylinder with a centering projection 24 which is formed on the end that can be associated with the piston head 5 and which is, at the same time, the support for the return spring 22 surrounding the piston shank 16. The stop face of the piston shank 16, said face interacting with the counterholder 19, is here formed by a ring 31 located on the outer surface of the shank.

In the case of an apparatus head 9 formed in this way, centering is performed solely by means of the larger—diameter centering projection 24 and the centering recess 14 in the piston head 5 which can be associated with it.

Centering directly in the cylinder bore of the hydraulic cylinder 8 is furthermore also conceivable, particularly when the piston head 5 is configured in the form of a disc according to the representation in FIG. 8.

It is also conceivable to screw the counterholder 19 into the bore 18 in the apparatus head 9, the said bore accommodating the hydraulic cylinder 8.

According to FIG. 8, the free end region of the piston shank 16 can also be formed with an integrally formed radial collar to form the centering projection 24, on which a supporting washer 23 for the return spring 22, the said supporting washer being pushed over the piston shank 16, is supported on the side facing away from the piston head.

In accordance with the embodiment in FIG. 8, the counterholder for guiding the piston shank 16 can also be formed as a radially inward-projecting annular collar on the apparatus head 9.

The two-part configuration according to the invention of the piston combined with the simultaneous association of the return spring 22 with the apparatus head 9 advantageously allows the various apparatus heads 9 disposed to be arranged on the different hand-held pressing apparatuses 1 according to FIG. 1 and FIG. 6. It-is thus possible to interchange the apparatus head.9 or the basic apparatuses 1 in a simple, modular manner. The user can choose between pressing- and cutting-apparatus heads, for example, or between electrically or lever-actuated basic apparatuses depending on the application.

The interchange is always effected on the dry side, i.e. the hydraulic side always remains closed off by the piston head 5, which remains in the basic apparatus.

By virtue of this configuration, hand-held pressing apparatuses 1 can furthermore also be preassembled, filled with oil and checked, after which a suitable apparatus head 9 can be mounted if required.

All features disclosed are pertinent to the invention. The disclosure content of the associated/attached priority documents (copy of the previous application) is herewith also incorporated in full into the disclosure of the application, also for the purpose of introducing features of these documents into claims of the present application.

What is claimed is:

1. Hand-held hydraulic pressing apparatus (1) comprising a hydraulic cylinder (8); a piston head (5) which is disposed in said hydraulic cylinder; and an interchangeable apparatus head comprising a tool carrier (10) and a piston shank (16) which extends from said tool carrier, said piston shank being connected to said tool carrier and selectively contactably engageable and disengageable from said piston head, said piston head and said piston shank forming a piston when said piston shank is engaged with said piston head, said piston being displaceable to carry out a pressing or cutting operation, said hand-held hydraulic pressing apparatus further comprising a return spring which is earned on said piston shank, said return spring being held captive on said piston shank and being configured to bias said piston.

2. Hand-held pressing apparatus according to claim 1, characterized in that the hand-held pressing apparatus is configured such that the piston head is releasable form the piston shank.

3. Hand-held pressing apparatus according to claim 1, or claim 3, characterized in that the piston head (5) has a centering recess (14) on the piston shank side and that the piston shank (16) has a centering projection (24) on the piston-head side.

4. Hand-held pressing apparatus according to claim 1 or characterized in that a cylindrically-headed screw (25) with a projecting cylindrical head (26) is mounted centrally in the piston shank (16) on the piston-head side to ensure centering on the piston head (5), the cylindrical head (26) being received in a corresponding recess (15) in the piston head (5).

5. Hand-held pressing apparatus according to claim 1, characterized in that the piston head (5) has a cup wall (13) on the piston-shank side.

6. Hand-held pressing apparatus according to claim 5, characterized in that the height of the cup wall (13) corresponds to more than a quarter of the length of the shank.

7. Hand-held pressing apparatus according to claim 1, characterized in that the hydraulic cylinder (8) has an external thread (12) at its end facing the apparatus head and the apparatus head (9) is connected to the hydraulic cylinder (8) by means of this thread (12).

8. Hand-held pressing apparatus according claim 1, characterized in that the location of a connection between the apparatus head (9) and the hydraulic cylinder (8) is defined by a pin provided at the apparatus head resiliently engaging the hydraulic cylinder.

9. Hand-held pressing apparatus according to claim 1, characterized in that the piston shank (16) is of stepped form and is connected to the apparatus head (9) by means of a counterholder component (19) which is supported on the apparatus head (9) and engages against the step face.

10. Hand-held pressing apparatus according claim 9, characterized in that the counterholder component (19) is screwed into a bore in the apparatus head (9) which accommodates the hydraulic cylinder (8).

11. Hand-held pressing apparatus according to claim 1, characterized in that the apparatus head (9) has a handle (27).

12. Hand-held pressing apparatus according to claim 11, characterized in that the handle (27) extends in the direction of motion of the piston or hydraulic cylinder (8).

13. Hand-held pressing apparatus according to claim 12, characterized in that the handle (27) is formed by an arc-shaped component (28) which merges into the apparatus head (9) at both ends.

14. Hand-held pressing apparatus according to claim 1, characterized in that the piston head (5) has a centering projection on the piston-shank side and in that the piston shank (16) has a centering recess on the piston-head side.

15. Hand-held hydraulic pressing apparatus according to claim 1, wherein the piston head is hydraulically pressurized when the apparatus is actuated.

16. Hand-held hydraulic pressing apparatus according to claim 1, wherein the piston head is disc-shaped and includes a radial seal.

* * * * *

UNITED STATES PATENT AND TRADEMARK OFFICE

CERTIFICATE OF CORRECTION

PATENT NO. : 6,718,870 B1
DATED : April 13, 2004
INVENTOR(S) : Egbert Frenken

It is certified that error appears in the above-identified patent and that said Letters Patent is hereby corrected as shown below:

Title page,
Item [57], ABSTRACT,
Line 1, “a hand held” should be -- a hand-held --

Column 3,
Line 27, “unscrewed form” should be -- unscrewed from --

Column 6,
Line 46, “forces form” should be -- forces from --

Column 8,
Line 1, “earned” should be -- carried --
Line 6, “form” should be -- from --
Line 8 and 9, “or claim 3,” should be deleted
Line 13, “or” should be deleted Signed and Sealed this Sixth Day of July, 2004

JON W. DUDAS
*Acting Director of the United States Patent and Trademark Office*